US005989363A

United States Patent [19]

Georges

[11] Patent Number: 5,989,363

[45] Date of Patent: Nov. 23, 1999

[54] NITRIDING PROCESS AND NITRIDING FURNACE THEREFOR

[75] Inventor: Jean Georges, Luxembourg, Luxembourg

[73] Assignee: Plasma Metal SA, Luxembourg, Luxembourg

[21] Appl. No.: 09/061,686

[22] Filed: Apr. 16, 1998

[30] Foreign Application Priority Data

Apr. 18, 1997 [EP] European Pat. Off. ..... 97630021

[51] Int. Cl.[6] ..... C23C 8/24

[52] U.S. Cl. ..... 148/222; 266/251; 266/252

[58] Field of Search ..... 148/222; 266/251, 266/252

[56] References Cited

U.S. PATENT DOCUMENTS 3,616,383 10/1971 Klausler ..... 148/122

3,730,863 5/1973 Keller ..... 148/122

4,900,371 2/1990 Dexter et al. ..... 148/122

5,589,221 12/1996 Hiramoto et al. ..... 148/122

*Primary Examiner*—Deborah Yee

*Attorney, Agent, or Firm*—Polster, Lieder, Woodruff & Lucchesi

[57] ABSTRACT

A nitriding process and nitriding furnace therefor wherein the parts to be treated are maintained at floating potentional in a vacuum furnace (9), current being provided to a metal screen (5) cathode surrounding the parts to be treated, the necessary heat being provided by radiation from screen (5) whereby nitriding gas is injected into the furnace such that it has to flow through screen (5) where the plasma necessary for the nitriding reaction is generated by glow discharge the plasma flowing around and reacting with the parts to be treated before it is evacuated at the bottom of furnace (9) through vacuum/exhaust conduit (2).

17 Claims, 1 Drawing Sheet

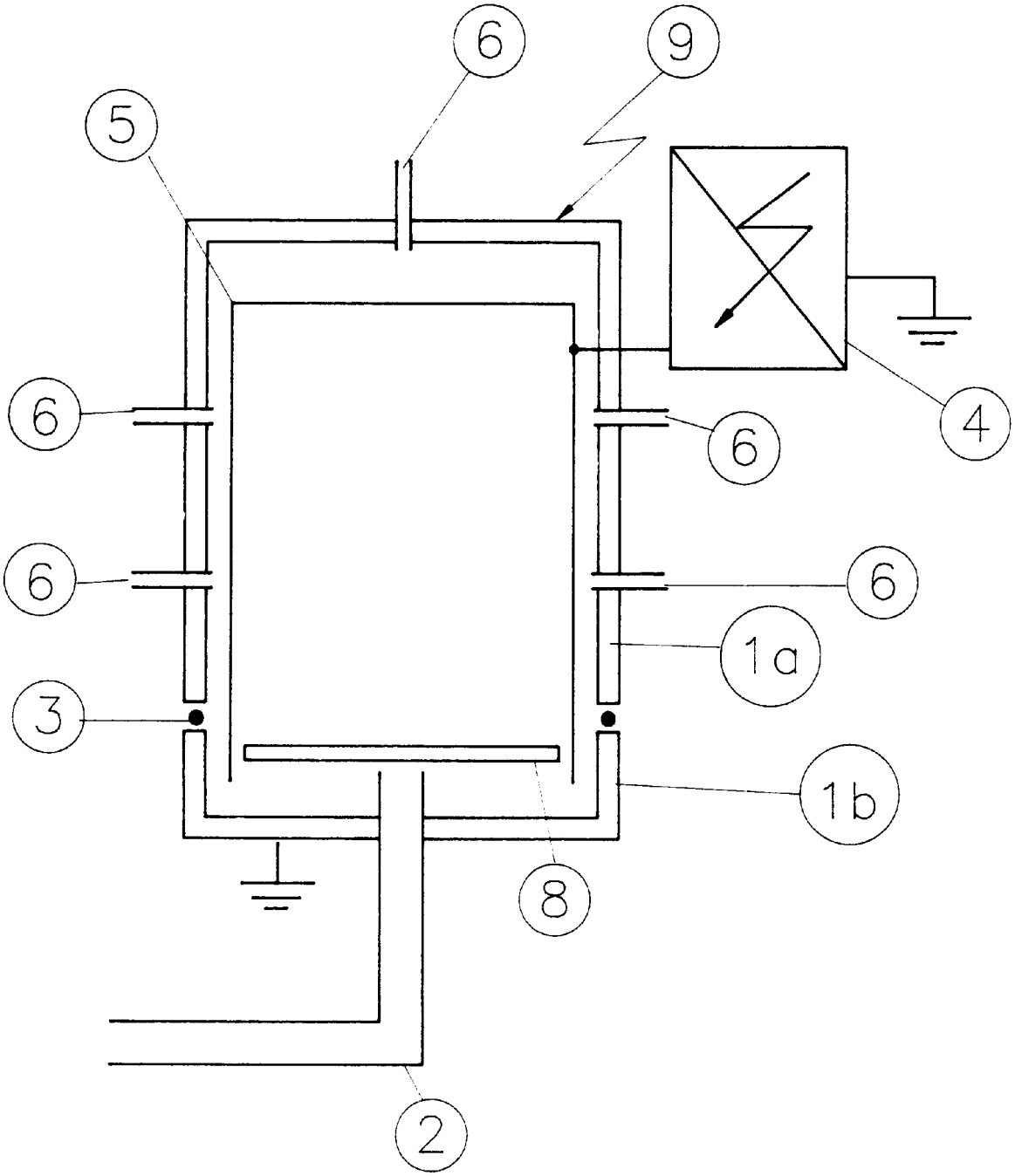
6
9
5
6
6
4
6
6
1a
3
1b
8
2

NITRIDING PROCESS AND NITRIDING FURNACE THEREFOR

The present invention relates to a novel plasma nitriding process and a nitriding furnace therefore wherein the metal parts to be treated are at floating potential and wherein the necessary heat is provided and plasma generated at a metal screen constituting the cathode.

The nitride hardening of metal parts (work pieces, tools and other metal articles) to improve their wear characteristics is well-known in the art. Three nitride hardening or nitriding processes are known namely nitriding by immersing the metal articles into molten salt baths, nitriding in the gas phase and finally nitriding in cold plasma.

Currently two cold plasma processes providing the active reagents necessary i.e. ions, electrons and other active energized neutral gaseous particles for the thermo-chemical reactions occurring on the surface of the parts to be treated are known.

The most common of these processes is the ionic nitriding process whereby the parts to be treated are placed inside a furnace where they constitute the cathode and where the grounded walls of the furnace constitute the anode. An electrical generator provides the current (pulsed or D.C.) necessary for heating the furnace and for generating a plasma.

To generate the plasma a gas, such as nitrogen, hydrogen, methane or others depending on the desired hardening is introduced into a vacuum chamber where a glow discharge generates the active reagents (ions, electrons and other active, energized neutral gaseous particles) directly on and around the surface of the metal parts to be treated.

In accordance with the second known process the active reagents are generated by microwave discharge in a plasma generator provided adjacent to and outside of the nitriding furnace. The plasma thus generated is directed into a vacuum furnace comprising the heated parts to be treated. This process is known in the art as post-discharge nitriding.

While both processes provide the desired nitride hardening and improve the wear characteristics of the treated parts they suffer from several drawbacks.

In the ionic nitriding process the parts to be treated constitute the cathode and provide the heat necessary for the nitriding process. The uneven shape and geometry of the parts to be treated make it very difficult to control the heat distribution in the furnace. Moreover as the number or parts as well as their shape or geometry vary from one load to another it is difficult to calibrate the furnaces, the heating characteristics varying with the load. This results in an uneven temperature throughout the chamber. Where, however, the temperature in industrial furnaces cannot be properly controlled the nitride hardening quality of the treated articles suffers.

The dual function of the load i.e. parts to be treated and cathode and the difficulties of direct temperature measurements on the cathode can lead to hot spots or overheating of the cathode. Such hollow cathode problems destroy the shape and/or geometry of precisely machined articles rendering the parts useless.

To prevent undesirable side effects of this order only articles having sensibly identical sizes, shapes and geometry should be treated simultaneously in a same load. The economic efficiency of these known furnaces is thus very unsatisfactory.

Moreover the articles to be treated have to be thoroughly cleaned of every organic surface impurities and have to be degreased before they can be used as cathodes in the nitriding furnace in order to prevent hot spots on the cathode.

In smaller furnaces the danger of unipolars arcs can be minimized. With larger furnaces, however, total current increases and thus the danger of unipolar arcs. These arcs impair the usefulness of the treated parts as they destroy the parts or modify the surface and geometry characteristics thereof.

In the furnaces of the art the positively charged ions travel to and hit the negatively charged cathode i.e. the parts to be treated. These impacts can be so violent that metal atoms are knocked out of the lattice. The parts are subject to a sandblasting-like effect. While this surface impairment is not dramatic and quite tolerable for most parts it is undesirable for highly polished surfaces. These have thus to be repolished after the nitriding process.

It is obvious for any man skilled the art that the use of the parts as a cathode and plasma generator in the furnace makes it very difficult to treat small bore articles or to treat economically a large number of small caliper articles in one load.

While the nitride hardening conditions are difficult to control in small furnaces of the known art, the difficulties are compounded in larger, industrial size furnaces.

The inventors of the post-discharge processes tried to overcome some of the difficulties discussed above. The processes necessitate, however a separate plasma generating chamber. The plasma generated in these chambers has to be transferred into the nitriding furnace in which the heated parts are disposed. The even and homogeneous distribution of the reagents on and around the parts to be treated is difficult to control. The problems are obviously magnified in large, industrial scale furnaces where it is very difficult to guarantee that sufficient plasma reaches distant areas of the furnace.

In these large furnaces problems arise also due to the limited useful life to the plasma particles. These particles may no more be active when they reach distant (as compared to the gas entry) areas of the vacuum furnace. Unevenably treated parts are obtained.

Whatever the process it is thus very difficult to obtain satisfactory results in large scale industrial furnaces and processes of the art.

Efforts have been made for some time to improve the control of the nitride hardening conditions of the known furnaces and processes. A satisfactory economical solution has not yet been disclosed.

It is therefor an object of the invention to provide a nitriding process allowing better control of the nitriding conditions whereby the parts to be treated at floating potential are heated by radiation from a metal screen cathode surrounding the parts to be treated a gas mixture being injected into the furnace such that it flows through the screen where the necessary plasma is generated by glow discharge before this highly ionized gas compound reaches and reacts with the parts.

It is a further object of the invention to provide a nitriding furnace allowing an economical simultaneous nitriding of parts having different shapes and geometry. This is achieved by a furnace wherein the parts to be treated are at floating potential, the reaction heat being provided by and the plasma being generated at a metal screen cathode surrounding the parts to be treated, gas entries being provided between the furnace wall and this metal screen cathode.

These and other objects and advantages of the invention will become more readily apparent from the following detailed description of preferred embodiments thereof, when taken in conjunction with the accompanying drawing.

The drawing shows a schematic view of a nitriding furnace.

In accordance with the novel process of the invention the parts to be treated are placed into a nitriding furnace where they are maintained at floating potential. Electric current is provided to a metal screen surrounding the parts to be treated. Heat to the furnace and parts is provided by radiation from the screen which constitutes the cathode of the furnace. Gas is introduced into the furnace between the grounded furnace walls and the metal screen cathode so that the gas flows through the screen. At the screen plasma is generated by glow discharge such that a mixture of ions, electrons and other active energized neutral gaseous particles come into contact with the parts to be treated. The gases are evacuated at the bottom of the furnace.

Referring now to the drawing the furnace (9) in accordance with the invention is constituted by an upper part (1*a*) and a bottom part (1*b*) joined by gas seal (3). A generator (4) provides the necessary pulsed or D.C. current to a metal screen cathode (5) surrounding a support (8) maintained at floating potential on which the articles to be treated rest. This screen (5), heated by current from generator (4) heats by radiation the interior of the furnace (9). As the characteristics of this screen are known and remain constant in the furnace it is possible to control the furnace temperature within a narrow range by controlling the current provided to this screen.

After placing the parts to be treated onto support (8) the upper part (1*a*) of the furnace is lowered onto the grounded bottom part (1*b*). A vacuum pump (not shown) eliminates the gases present in the furnace through vacuum/exhaust conduit (2). After the establishment of a pressure inferior to 20 micro bar within the furnace generator (4) is switched on to provide a current of 20–50 $W/dm^2$ to screen (5). When the screen has reached the necessary temperature corresponding to an internal homogenous and uniform temperature of 300 to 600° C. a gas mixture constituted of nitrogen and neutral gases such as hydrogen and/or argon is injected into the furnace at different levels through gas injection conduits (6). The gas injection conduits (6) enter the reactor outside of screen (5) such that the gases have to flow through screen (5). The glow discharge at the screen (5) generates the plasma of highly ionized gas constituted of ions, electrons and other active, energized neutral gaseous particles necessary for nitriding the parts on support (8).

As the gases are continuously evacuated through vacuum/exhaust conduit (2) the plasma generated at the screen flows downward and around the parts on support (8). The parts are continuously bathed in a gentle flow of the active reagents before the plasma is evacuated through conduit (2).

The gas injection conduits are distributed over the entire surface of the furnace and the vacuum exhaust conduit or conduits are disposed such that a constant homogeneous plasma flow around the parts to be treated is obtained. The actual location of these conduits will depend on the size and form of the furnace. Preferably the vacuum/exhaust conduit (2) is provided at the center and near the bottom surface of support (8).

By providing the entry of vacuum/exhaust conduit (2) at the center and near the bottom surface of support (8) a continuous flow of plasma to the parts is guaranteed and any contact of these parts with the injected untreated gases is prevented.

For most applications a furnace temperature of between about 300 and 600° C. is adequate. For special alloys, however higher temperature up to about 800° C. could be used.

In contradistinction to the furnaces of the prior art, it is not the parts to be treated that are used as heating elements and as plasma generators. Rather metal screen (5) constitutes the cathode and is used both to heat the interior of the reactor and the parts to be treated and to generate the plasma of ions, electrons and other neutral particles necessary for the nitriding reaction.

As current is no more applied to the parts to be treated all problems associated with overheating or hot spots, be they due to impurities remaining on the parts or to shape or geometry, have been overcome. With the process of the invention it is possible to treat parts, work pieces or tools or other articles without resorting to time consuming cleaning or degreasing processes.

For the treatment of special steels parts, for example stainless steel parts, or other parts made of special materials depolarization or a surface activation is often required. In these instances cleaning and degreasing of these parts before they are loaded into the furnace is recommended. For the depolarization of the parts current is applied, as in the prior art process, to support (8) such that the parts to be treated constitute, for a short period of time, the cathode. After having achieved the depolarization either by plasma generation on the parts and/or by the above disclosed sandblasting-like effect the current to support (8) is switched off to allow the nitride hardening process of the invention to proceed with support (8) and the parts thereon at floating potential.

For some nitriding processes, depending on the steel alloys that have to be treated, the geometry of the parts and/or the density of the load i.e. parts very close together it is preferable to apply a weak current to the support (8) and thus to the parts. The parts are thus no more at floating potential but constitute a weak cathode within the furnace. The weak cathode character will guarantee a more even distribution of the plasma on and around the parts to be treated and will thus further improve the homogeneous nitriding achieved by the process of the invention.

The current applied in accordance with this invention will be very weak when compared to the current applied in the prior art. Thus, whereas in the prior art currents of 60 to 100 KW depending on the load and the size of the furnace were applied to the support the current applied in the process of this invention will be less than 1 KW. It is obvious to a man skilled in the art that the current to be applied will depend on the load of parts to be treated. Whatever this load, the current should preferably not exceed 1 KW.

The application of a weak current to the support (8) will guarantee a uniform homogeneous nitriding result for parts with a complicated geometry and for very high density loads and even for the bulk treatment of small parts.

Considering that no current or only a very weak current is applied to the parts to be treated during the nitriding process no unipolar arc problems impairing the surface, shape or geometry characteristics of the parts can arise.

As the parts are not on only weakly negatively charged there is no violent impact of positively charged ions onto these parts. The bathing of the parts on support (8) by the plasma generated by glow discharge at screen (5) thus not only guarantees that the entire surface inclusive of any holes or recesses is equally and continuously in contact with freshly generated plasma and that the entire surface of the parts is uniformly treated but the gentle flow of the plasma on and around the parts does not lead to a sandblasting-like effect such that the surfaces of the parts are not at all impaired.

For the novel process of the invention the amount and speed of injection of the gas mixture into the furnace are not critical. It is only necessary to ascertain that a sufficient amount of gas is injected to provide the ions and particles necessary for the nitriding reaction.

Typically a mixture of nitrogen and neutral gases such as hydrogen and/or argon is used. It is however possible to add other active gases to this mixture such as methane, propane, hydrogen sulfide, carbon fluoride etc. Indeed, it is self evident that the apparatus and process disclosed may not only be used for nitride hardening processes but also for nitride-carbide hardening, oxy-nitride carbide hardening, sulfo nitride hardening. The different types of hardening obtained depend only on the composition of the reactive gases injected into the furnace.

For carrying out the process of the invention in the novel furnace the composition, size and other characteristics of metal screen (5) cathode are not critical. Due to the fact that the heating of the furnace is no more obtained from the radiation of varying quantities of parts of different shapes and geometry it is possible to precisely calibrate the furnaces of the invention. It is sufficient to vary the current density provided to the screen to control the furnace temperature within narrow limits and obtain a uniform temperature throughout the furnace.

In the novel furnace and process of the invention the plasma generated at the screen (5) flows gently around the parts to be treated independently of the size and form of the furnace. The novel process and furnace allows the economical treatment of parts of different size, bore, shape or geometry in a single load even the treatment of parts in bulk in the furnace without any impairment of the nitride hardening or other surface, shape of geometry characteristics of the parts thus treated.

As the furnace is no more heated by current applied to the parts to be treated hot spots or other overheating problems do no more occur. The provision of heat by radiation from screen (5) guarantees an uniform temperature profile throughout the furnace. As the radiation heat can be controlled by the amount of current provided to a screen having a known size and characteristics the temperature control becomes easy. By a judicious distribution of the gas injection conduits (6) to guarantee an ample and continuous supply of plasma to the parts to be treated, furnaces with two or more super imposed supports (8) can be built thus further improving the economics of the inventive process.

It is evident to men skilled in that art that the furnace of the invention can further be provided with devices known in the art, such as measuring devices, look through glasses, forced cooling devices which do not form part of the present invention. It is also possible to sputter rare earth elements for example lanthanum onto the parts to be treated. The rare earth elements have a catalyzing effect and speed up the diffusion of the plasma into the metal lattice of the parts.

I claim:

1. A nitriding process wherein a plasma is generated in a furnace in which parts to be treated are mounted on a support, said furnace being maintained at a temperature of about 300 to 800° C. and an interior pressure less than about 20 mbar, characterized by providing current to a metal screen cathode surrounding the parts to be treated, heating the furnace and the parts to be treated by radiation from this screen, the parts to be treated being maintained at floating potential, and by injecting a gas mixture into the furnace such that the gas flows through the metal screen cathode where the plasma necessary for the nitriding reaction is generated by glow discharge, the plasma thus generated flowing to the parts to be treated, and the gases being evacuated through a conduit provided beneath the parts to be treated.

2. Process according to claim 1, characterized in that the gas mixture is constituted of nitrogen, hydrogen and/or argon.

3. Process according to claim 2, characterized in that the gas mixture comprises additionally methane, propane, hydrogen sulfide and/or carbon fluoride.

4. Process according to claim 1, characterized in that a current of about 20 to 60 $W/dm^2$ is applied to said screen.

5. Process according to claim 2, characterized in that a current of about 20 to 60 $W/dm^2$ is applied to said screen.

6. Process according to claim 3, characterized in that a current of about 20 to 60 $W/dm^2$ is applied to said screen.

7. Process according to claim 1, characterized in that a weak current of less than about 1 KW is applied to the support.

8. Process according to claim 2, characterized in that a weak current of less than about 1 KW is applied to the support.

9. Process according to claim 3, characterized in that a weak current of less than about 1 KW is applied to the support.

10. Process according to claim 4, characterized in that a weak current of less than about 1 KW is applied to the support.

11. A nitriding furnace comprising an upper part and a bottom part and a seal therebetween, a support for metal parts to be treated in an interior space in said furnace defined by a furnace wall, a gas exhaust/vacuum conduit communicating with said interior space of said furnace, a current generator for the nitride hardening of said metal parts, a metal screen (5) surrounding said support (8), the generator (4) being connected to the metal screen which constitutes the cathode of the furnace, and gas injection conduits (6) disposed around the furnace and communicating with said interior space between the furnace wall and metal screen (5).

12. The furnace according to claim 11, characterized by at least two super imposed supports (8) within the metal screen (5).

13. The furnace according to claim 11, characterized in that the current applied to screen (5) is of about 20 to 50 $W/dm^2$.

14. The furnace according to claim 12, characterized in that the current applied to screen (5) is of about 20 to 50 $W/dm^2$.

15. The furnace according to claim 11, characterized by a connection of the support or supports (8) to generator (4) where the current applied is lower than 1 KW.

16. The furnace according to claim 12, characterized by a connection of the support or supports (8) to generator (4) where the current applied is lower than 1 KW.

17. The furnace according to claim 13, characterized by a connection of the support or supports (8) to generator (4) where the current applied is lower than 1 KW.

* * * * *